US006238276B1

(12) United States Patent
Miyazaki et al.

(10) Patent No.: US 6,238,276 B1
(45) Date of Patent: May 29, 2001

(54) SIZING LAPPING APPARATUS

(75) Inventors: Masaharu Miyazaki; Isao Nakabayashi, both of Niigata-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/441,351

(22) Filed: Nov. 16, 1999

(30) Foreign Application Priority Data

Nov. 27, 1998 (JP) ..... 10-338256

(51) Int. Cl.[7] ..... B24B 7/00

(52) U.S. Cl. ..... 451/266; 451/5; 451/9; 451/10; 451/41; 451/63; 451/270

(58) Field of Search ..... 451/5, 9, 10, 11, 451/41, 63, 270, 287, 294, 259

(56) References Cited

U.S. PATENT DOCUMENTS

| | | | | |
|---|---|---|---|---|
| Re. 35,477 | | 3/1997 | Hussinger et al. . | |
| 3,708,919 | * | 1/1973 | Isaev et al. | 451/114 |
| 4,010,574 | * | 3/1977 | Feierabend et al. | 451/272 |
| 5,095,613 | | 3/1992 | Hussinger et al. . | |
| 5,203,119 | * | 4/1993 | Cole | 451/11 |
| 5,321,882 | | 6/1994 | Zarouri et al. . | |
| 5,406,694 | | 4/1995 | Ruiz . | |
| 5,722,156 | | 3/1998 | Balfrey et al. . | |
| 5,735,036 | * | 4/1998 | Barr et al. | 29/603.12 |
| 5,910,041 | * | 6/1999 | Duescher | 451/28 |

FOREIGN PATENT DOCUMENTS 1-153242 6/1989 (JP) .

* cited by examiner

*Primary Examiner*—Joseph J. Hail, III
*Assistant Examiner*—Shantese McDonald
(74) *Attorney, Agent, or Firm*—Brinks Hofer Gilson & Lione

(57) ABSTRACT

A sizing lapping apparatus includes a rotatably provided disk-shaped lap plate for supplying a lapping liquid thereto; at least one holding portion for holding a workpiece, the at least one holding portion being used to press the workpiece against the lap plate; a support shaft, provided in an erected state with respect to the lap plate, for supporting the at least one holding portion; an oscillating mechanism for causing the support shaft to undergo oscillatory rotational motion around an axis thereof; a base for supporting the support shaft so that the support shaft freely rotates around the axis thereof; and a base rocking mechanism for reciprocating the base in a diametrical direction of the lap plate or in a direction substantially parallel to the diametrical direction. The sizing lapping apparatus can carry out lapping operations with very high precision. This is made possible by partly adjusting the amount by which the workpiece is lapped, in accordance with the lapping state of the workpiece.

15 Claims, 10 Drawing Sheets

SIZING LAPPING APPARATUS

BACKGROUND OF THE INVENTION

1. Field of the Invention

The present invention relates to a sizing lapping apparatus which can perform lapping operations with high precision when, for example, a slider of a floating-type magnetic head used in a magnetic disk unit is produced by lapping.

2. Description of the Related Art

An increase in the recording density of magnetic disks has encouraged the production of smaller and lighter floating-type magnetic head sliders used in magnetic disk units, year after year. At present, thin-film magnetic heads are primarily used. In such thin-film magnetic heads, the magnetic gap portion has a very fine structure, making the precision of lapping operations carried out during the manufacturing process a very important factor in determining the quality of the magnetic heads that have been manufactured.

In manufacturing such magnetic head sliders, a plurality of films are deposited on one piece of wafer by a deposition method, during which required circuits are written by a lithography technique in order to form a plurality of thin-film magnetic heads on the piece of wafer at the same time. Then, the plurality of thin-film magnetic heads are sliced from the piece of wafer, whereby the plurality of thin-film magnetic heads are mass-produced. Accordingly, in this manufacturing method, when the thin-film magnetic heads are not precisely processed when they are sliced from the wafer, magnetic head yield may be considerably reduced.

Hitherto, in the case where thin-film magnetic heads are mass-produced by slicing them from a wafer, the gaps of the magnetic gap portions of the thin-film magnetic heads had been formed by the following method.

As illustrated in FIG. 10, a plurality of thin-film magnetic head devices are formed in rows on a wafer 1, which is sliced in a horizontal direction (in FIG. 10) to obtain a sliced-out bar 2 (shown in FIG. 11). As shown in FIG. 12 (which is an enlarged view of the bar 2), a plurality of thin-film magnetic head devices 5 are formed in a row on the bar 2. Each thin-film magnetic head device 5 shown in FIG. 12 comprises a coil portion 6; and four electrode pads 7 that are arranged at one side of its corresponding coil portion 6. To the electrode pads 7 are connected lead wires extending from the corresponding coil portion 6 and lead wires extending from an internal circuit of the corresponding thin-film magnetic head devices 5.

FIG. 13 illustrates an enlarged view of a thin-film magnetic head device 5 of FIG. 12. In the structure of the thin-film magnetic head, the depth to which the gap of a magnetic gap portion g, formed adjacent to the end portion of the coil portion 6, is formed is very important because it directly determines the performance of the thin-film magnetic head 5. Therefore, the bar 2 is mounted to a sizing lapping apparatus in order to lap the top surface of the bar 2 precisely.

In the case where the thin-film magnetic head is a GMR head using a huge magnetoresistive effect element (GMR element), the depth of the gap portion of a read/write head (for reading and writing magnetic signals), the throat height (equivalent to the length of an end portion of a magnetic pole of the read/write head), and the MR height (equivalent to the depth of the gap portion of the read/write head) all depend upon the precision with which the lapping surface is lapped. In addition, both gap portions need to be lapped together. Therefore, it is necessary to achieve very precise lapping operations.

Conventional sizing lapping apparatuses comprise a lap plate, to which a lapping liquid is supplied. In general, when lapping operations are carried out by conventional sizing lapping apparatuses, the lap plate is rotated while a workpiece is pressed against it. In the case where a member such as that in which a sliced bar 2 having a plurality of thin-film magnetic head devices 5 formed thereon is to be lapped precisely, lapping precision may not be satisfactory. In recent years, there has tended to be a demand for such thin-film magnetic heads, in particular, to be lapped very precisely to an order equal to or less than ±0.1 $\mu$m.

The plurality of thin-film magnetic head devices 5 are formed on the sliced bar 2 by a deposition method. Although they are arranged very precisely on the wafer 1, they may go out of alignment due to bending or deformation of the bar 2 sliced from the wafer 1. Even in such a case there has been a demand for high-performance sizing lapping apparatuses which can perform lapping operations with high precision.

SUMMARY OF THE INVENTION

Accordingly, it is an object of the present invention to provide a high-performance sizing lapping apparatus which can perform lapping operations with very high precision. It is another object of the present invention to provide a sizing lapping apparatus which can perform lapping operations very precisely by partly controlling the amount by which the workpiece is lapped in accordance with the lapping condition thereof. It is still another object of the present invention to provide an apparatus which can perform lapping operations very precisely by correcting workpiece bending.

To these ends, according to the present invention, there is provided a sizing lapping apparatus comprising a rotatably provided disk-shaped lap plate for supplying a lapping liquid thereto; at least one holding portion for holding a workpiece, the at least one holding portion being used to press the workpiece against the lap plate; a support shaft, provided in an erected state with respect to the lap plate, for supporting the at least one holding portion; an oscillating mechanism for causing the support shaft to undergo oscillatory rotational motion around an axis thereof; a base for supporting the support shaft so that the support shaft freely rotates around the axis thereof; and a base rocking mechanism for reciprocating the base in a diametrical direction of the lap plate or in a direction substantially parallel to the diametrical direction of the lap plate.

The support shaft that supports the at least one holding portion may oscillate freely around the axis thereof at an angle within a range equal to or less than 90 degrees and alternately towards the left and right.

In the case where the support shaft that supports the at least one holding portion oscillates freely around the axis thereof at an angle within a range equal to or less than 90 degrees and alternately towards the left and right, the holding portion that supports the workpiece may comprise a correction jig having the workpiece mounted thereto; a mounting jig for gripping the correction jig; and a pressing mechanism for freely pressing towards the lap plate a center portion side and both end portion sides of the correction jig by separate pressing forces.

In the case where the holding portion that supports the workpiece comprises a correction jig having the workpiece mounted thereto; a mounting jig for gripping the correction jig; and a pressing mechanism for freely pressing towards the lap plate a center portion side and both end portion sides of the correction jig by separate pressing forces, the holding portion may have provided thereat a plurality of rods which separately and freely move closer to and away from the lap plate, with the rods freely and separately pressing against the lap plate both end portion sides and a center portion side of the workpiece supported by the holding portion.

In the case where the holding portion has provided thereat a plurality of rods which separately and freely move closer to and away from the lap plate, with the rods freely and separately pressing against the lap plate both end portion sides and a center portion side of the workpiece supported by the holding portion, the holding portion may further have provided thereat a mounting jig having the workpiece secured thereto, with a dummy head for balancing and adjusting lapping operations being mounted at the mounting jig, and with a point to which pressure is applied towards the lap plate by the support shaft corresponding to an intermediate point between the workpiece and the dummy head.

DESCRIPTION OF THE PREFERRED EMBODIMENT

Hereunder, a detailed description of an embodiment of the present invention will be given with reference to the drawings. It is to be noted that the present invention is not limited to this embodiment.

Figure 1:
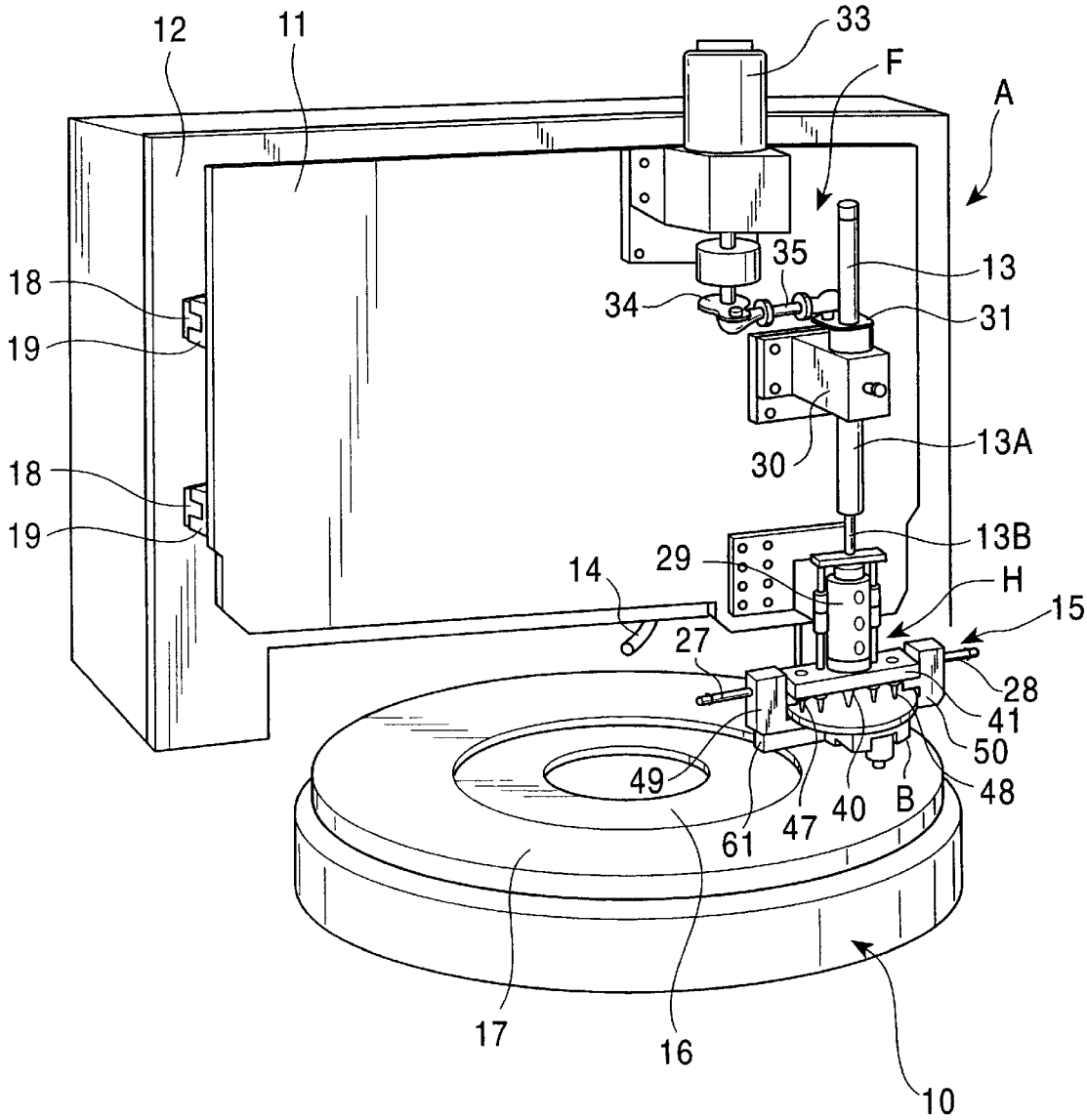
FIG. 1 is a perspective view of an embodiment of the lapping apparatus in accordance with the present invention.
Figure 2:
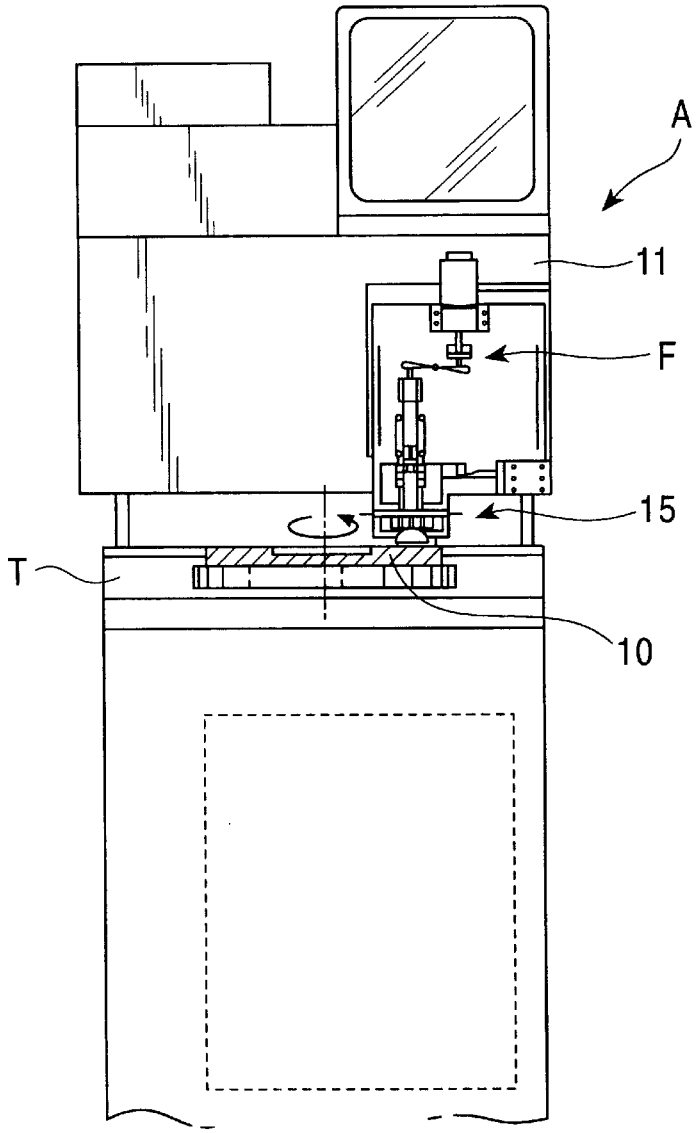
FIG. 2 is a front view of the lapping apparatus of FIG. 1.

FIGS. 1 to 5 illustrate an embodiment of the lapping apparatus of the present invention. The lapping apparatus A primarily comprises a disc-shaped lap plate 10 disposed on a table T (shown in FIG. 2) so as to be rotatable horizontally; a plate-shaped base 11 provided in a standing manner at the back side of the lap plate 10, as shown in FIG. 1; a supporting wall 12 provided in a standing manner at the back side of the base 11; a support shaft 13 supported in an erected state at a front face of the base 11 at the lap plate side; and a holding portion 15 provided at the lower end of the support shaft 13.

The lap plate 10 is supported by a rotation driver that uses a motor (not shown) provided in the table T so that it can freely rotate. A round recess 16 is formed in the center portion of the top surface of the lap plate 10, and the top surface of the lap plate 10 surrounding the recess 16 is defined as lap surface 17. At the back side of and above the lap surface 17 are provided a lapping liquid supplier (not shown) and a supplying tube 14. They are constructed so that lapping liquid containing abrasives, such as diamond grains, can be supplied to the entire lap surface 17 by spreading it on the lap surface 17 by the rotational force of the lap plate 10.

Rail members 18 and 18 are mounted substantially horizontally to the front face of the supporting wall 12 at the lap plate 10 side. Rail receiving members 19 and 19 are provided so as to engage their corresponding rail members 18 and 18, and are connected to the back surface of the base 11. Accordingly, the base 11 is supported so that it can reciprocate horizontally towards the left and towards the right along the rail members 18 and 18.

Figure 3:
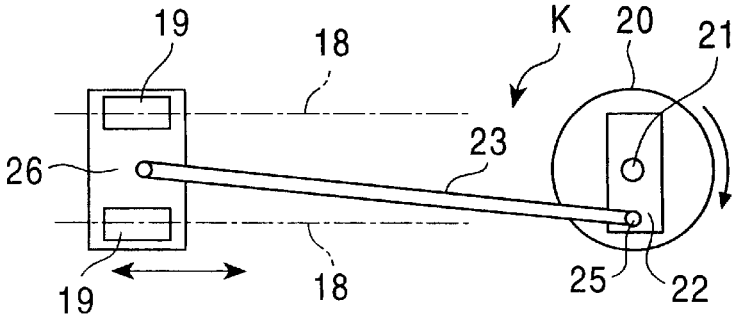
FIG. 3 is a structural view of a base rocking mechanism of the lapping apparatus of FIG. 1.

As shown in FIG. 3, at the front face side of the supporting wall 12 are provided a motor 20 and a link arm 23, both of which are positioned between the supporting wall 12 and the base 11. One end of the link arm 23 is rotatably connected by a pin 25 to an end portion of an arm plate 22, mounted to a rotary shaft 21 of the motor 20. On the other hand, the other end of the link arm 23 is rotatably connected by a pin 27 to the center portion of a drive plate 26. The rail receiving members 19 and 19 are mounted at the upper portion and at the lower portion of the drive plate 26, respectively.

By virtue of this structure, as the motor 20 rotates, the arm plate 22 rotates. This causes the one end of the link arm 23 to undergo decentered rotation, and the other end of the link arm 23 to make the drive plate 26 reciprocate towards the left and right along the rail members 18 and 18. This allows the base 11 to reciprocate in parallel towards the left and right. In this embodiment, the motor 20, the arm plate 22, the link arm 23, the pins 25 and 27, the rail receiving members 19 and 19, and the rail members 18 and 18 form a base rocking mechanism K.

It is to be noted that although in the embodiment the base rocking mechanism K with the above-described structure is used to reciprocate the base 11 towards the left and right, it is obvious that it can take other structural forms to move the base 11.

As shown in FIG. 1, to the front face of the base 11 is mounted a bearing member 30 for supporting the support shaft 13 erected substantially vertically. The support shaft 13, in an erected state, is supported so as to be rotatable around an axis thereof. A cam plate 31 is mounted substantially horizontally to the upper portion of the support shaft 13. A motor 33 is mounted at the front face of the base 11 so as to be disposed at the center portion of the top portion of the base 11. The rotary shaft of the motor 33 is faced downward, and the cam member 34 is mounted to the lower end portion of the rotary shaft of the motor 33 so as to extend substantially horizontally. An end portion of the cam plate 31 and an end portion of the cam member 34 are connected to a connecting arm 35 by a pin.

Therefore, when the cam member 34 rotates as a result of rotation of the motor 33, the connecting arm 35 undergoes decentered rotation, causing the cam plate 31 to undergo reciprocating oscillatory motion, so that the support shaft 13 undergoes reciprocating oscillatory motion within a predetermined angle range of 90 degrees or less. In the embodiment, the motor 33, the cam member 34, the connecting arm 35, and the cam plate 31 form a support shaft 13 oscillating mechanism F.

It is to be noted that in the embodiment although a support shaft oscillating mechanism F having the above-described structure is used to cause the support shaft 13 to undergo rotational oscillatory motion, it is obvious that it can take other structural forms to move the support shaft 13.

A slide shaft 13B is provided at the lower portion of the support shaft 13 through a slide joint 13A. It is supported by a bearing member 29 that is secured to the base 11, with the holding portion 15 being mounted to the lower portion of the slide shaft 13B. It can slide vertically, and is constructed so that attachment and removal of the holding portion 15 can be achieved as described below.

Figure 4:
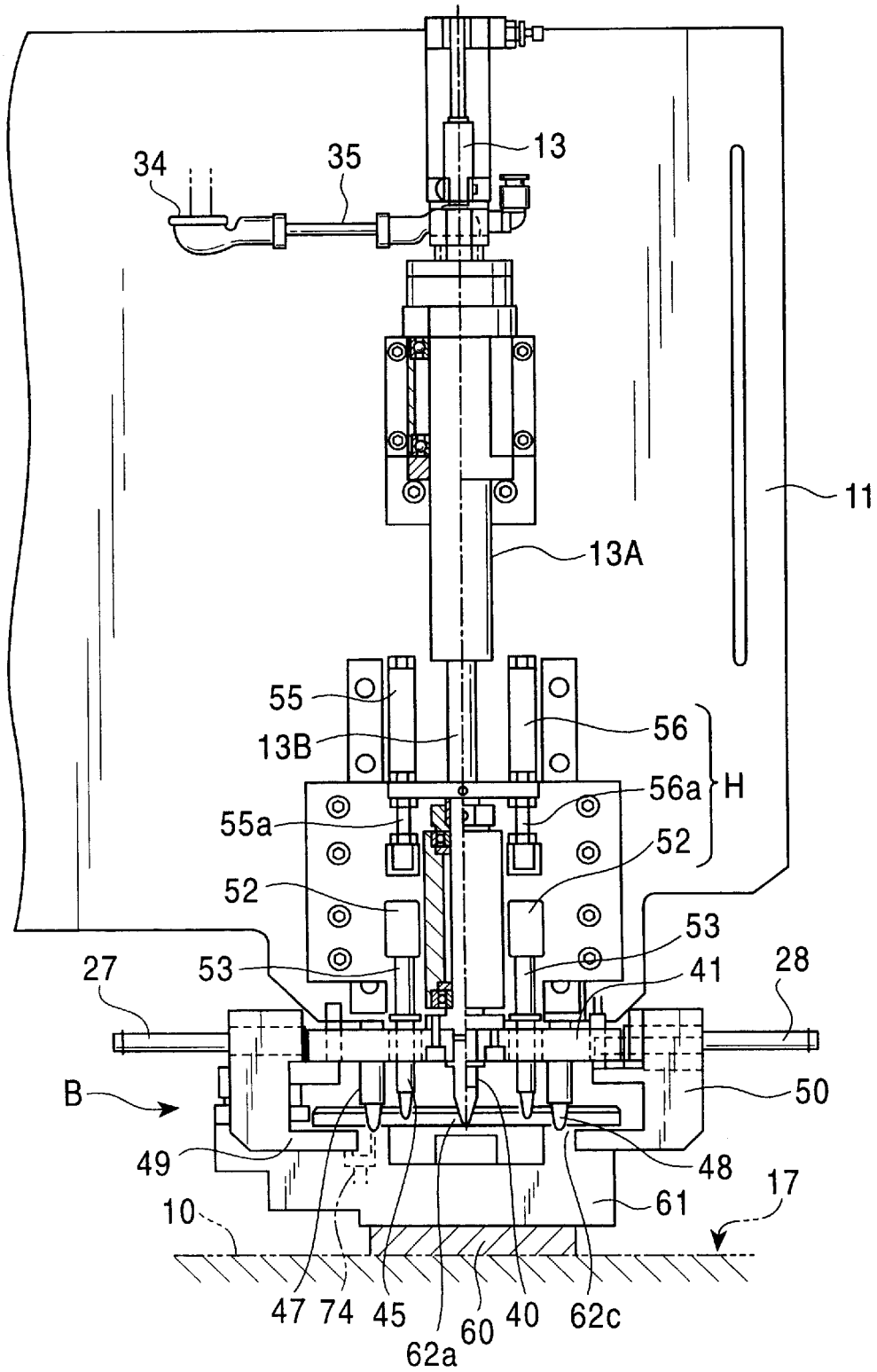
FIG. 4 is an enlarged front view of a holding portion of the lapping apparatus of FIG. 1.
Figure 5:
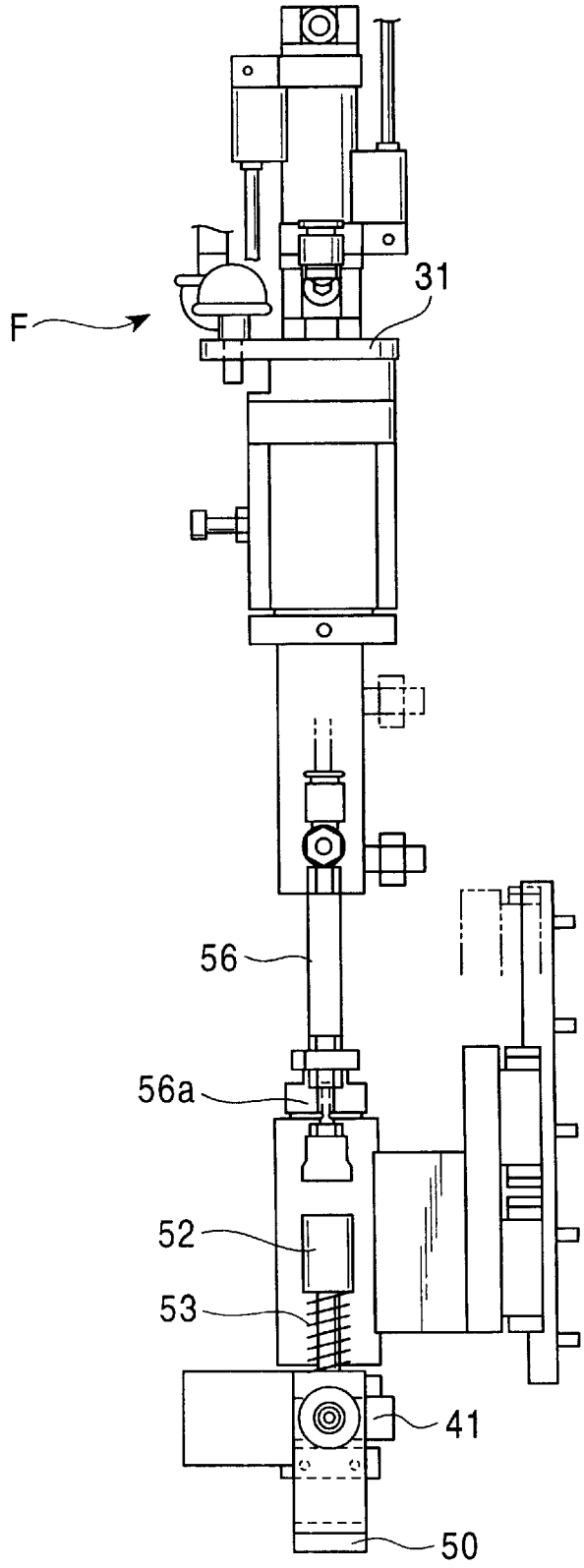
FIG. 5 is an enlarged side view of the holding portion of the lapping apparatus of FIG. 1.

As shown in FIGS. 1 and 4, the holding portion 15 primarily comprises a presser rod 40, support blocks 41, adjuster rods 45 and 46, rocking rods 47 and 48, the support rod 27, the support rod 28, an L-shaped support pawl 49, and an L-shaped support pawl 50. The presser rod 40 is provided at the lower end of the slide shaft 13B. The support blocks 41 and 41 are formed substantially horizontally at the left and right sides of the presser rod 40. It extends substantially parallel to the base 11. The adjuster rods 45 and 46 extend vertically through the support blocks 41 and are positioned at the left and right sides of the presser rod 40 so as to be movable vertically. The rocking rods 47 and 48 are positioned at the left and the right sides of the adjuster rods 45 and 46, respectively, so as to be movable vertically. The support rod 27 is formed on the left side of the corresponding support block 41 so as to extend substantially horizontally. The support rod 28 is formed on the right side of the corresponding support block 41 so as to extend substantially horizontally. The support pawl 49 is provided so as to be movable horizontally along the support rod 27. The support pawl 50 is provided so as to be movable horizontally along the support rod 28.

Head portions 52 are formed at the top portions of the adjuster rods 45 and 46, respectively. At the adjuster rod 45, a resilient member 53, such as a coil spring, is interposed between its corresponding head portion 52 and support block 41. At the adjuster rod 46, a resilient member 53, such as a coil spring, is interposed between its corresponding head portion 52 and support block 41. The adjuster rods 45 and 46 are constructed so that by pushing their head portions 52 from thereabove, they are pushed downward against the resilient forces of their respective resilient members 53. Cylinder devices 55 and 56 are provided above the adjuster rods 45 and 46, respectively, in order to push them down. The cylinder devices 55 and 56 are constructed so that by adjusting the amount by which piston rods 55*a* and 56*a* of their respective cylinder devices 55 and 56 are pushed downward, the amount by which the adjuster rods 45 and 46 are pushed downward are adjusted.

Figure 6:
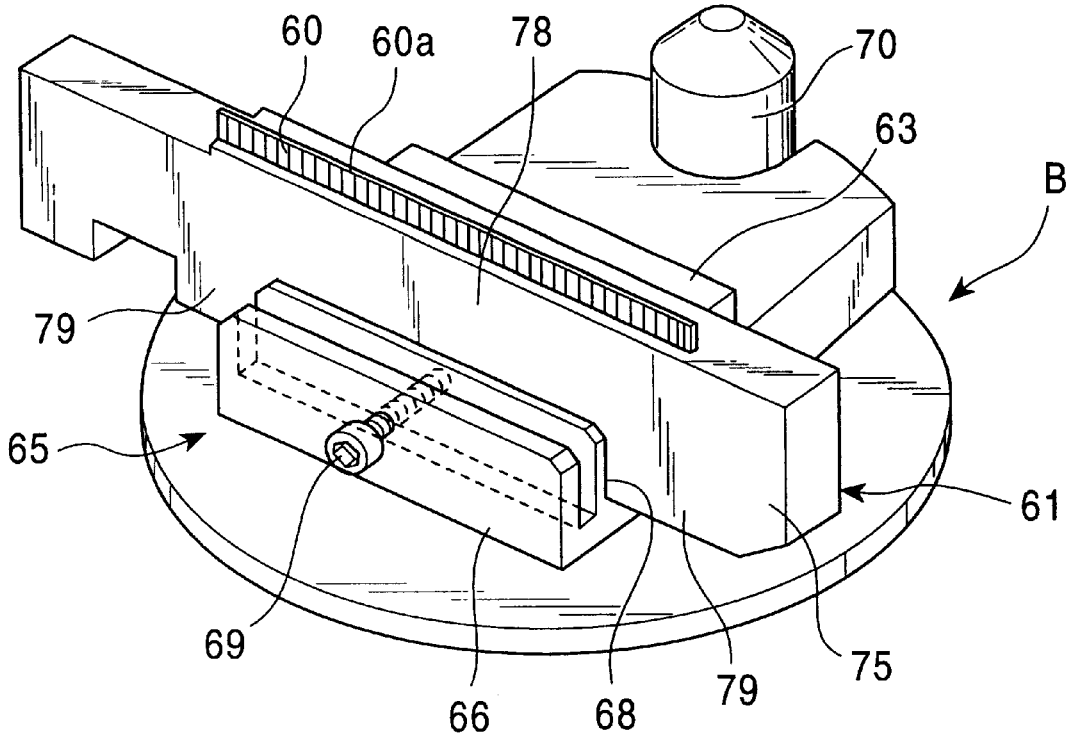
FIG. 6 is a perspective view of a workpiece, a correction jig, and a mounting jig, provided at the lapping apparatus of FIG. 1.

Primarily with reference to FIG. 6, a description will hereunder be given of a mounting jig, which is supported by the holding portion 15 having the above-described structure and which can have a workpiece mounted thereto.

FIG. 6 illustrates mounting jig B, which is a form of the mounting jig used in the present invention. The mounting jig B is provided to secure and support a block-shaped correction jig 61, having a bar-shaped workpiece 60 bonded thereto, by sandwiching the correction jig 61. It comprises a disk-shaped substrate 62, a receiving seat 63 integrally formed on the substrate 62, and a pressing mechanism 65 that is separated from and that opposes the receiving seat 63. It is constructed so that the correction jig 61 can be secured as a result of sandwiching it by the receiving seat 63 and the pressing mechanism 65, at a location slightly away from the center portion of the substrate 62.

The aforementioned pressing mechanism 65 primarily comprises a supporting substrate 66, a presser plate 68, and an adjuster bolt (length adjusting member) 69. The supporting substrate 66 is provided on the substrate 62 in a standing manner so as to be separated from the receiving seat 63. The presser plate 68 is provided between the supporting substrate 66 and the receiving seat 63 in a standing manner. The adjuster bolt 69 is screwed into a threaded hole formed in the center portion of the supporting substrate 66.

The above-described structure of the pressing mechanism 65 is such that when the presser plate 68 is displaced by rotating the adjuster bolt 69 along the threaded hole in the supporting substrate 66 in order to sandwich the correction jig 61 between the receiving seat 63 and the presser plate 68, the correction jig 61 is precisely gripped in a direction parallel to a diametrical direction thereof, at a location slightly separated from the center portion of the substrate 62.

A dummy head 70, being formed as a portion of the peripheral portion of the substrate 62, is provided opposite to the side where the correction jig 61 is mounted. It is secured to the substrate 62 so that a truncated conical tip surface thereof is formed at the same height as an end surface of the workpiece 60 on the correction jig 61. The tip of the dummy head 70 and both ends of an end surface 60*a* (the portion of the workpiece 60 to be lapped) are disposed above the substrate 62 so that they are located at vertices of a triangle formed by joining the tip of the dummy head 70 and both ends of the end surface 60*a* with a line. Since it is preferable that the dummy head 70 be of about the same hardness as the workpiece 60 (such as a magnetic head slider) to be lapped, it is preferable that it be specifically formed of MgO or $CaTiO_3$, or $Al_2O_3$—TiC or other ceramic materials.

As shown in FIG. 6, the correction jig 61 comprises a block-shaped body 75 that is long in the horizontal dimension. It has a base 79 formed at the lower portion side thereof (or at the side that is closer to the substrate 62 of the mounting jig B). It is provided to support the workpiece 60, to be bonded to the top surface of a protruding support 78 formed at the top portion of the correction jig 61.

Figure 7:
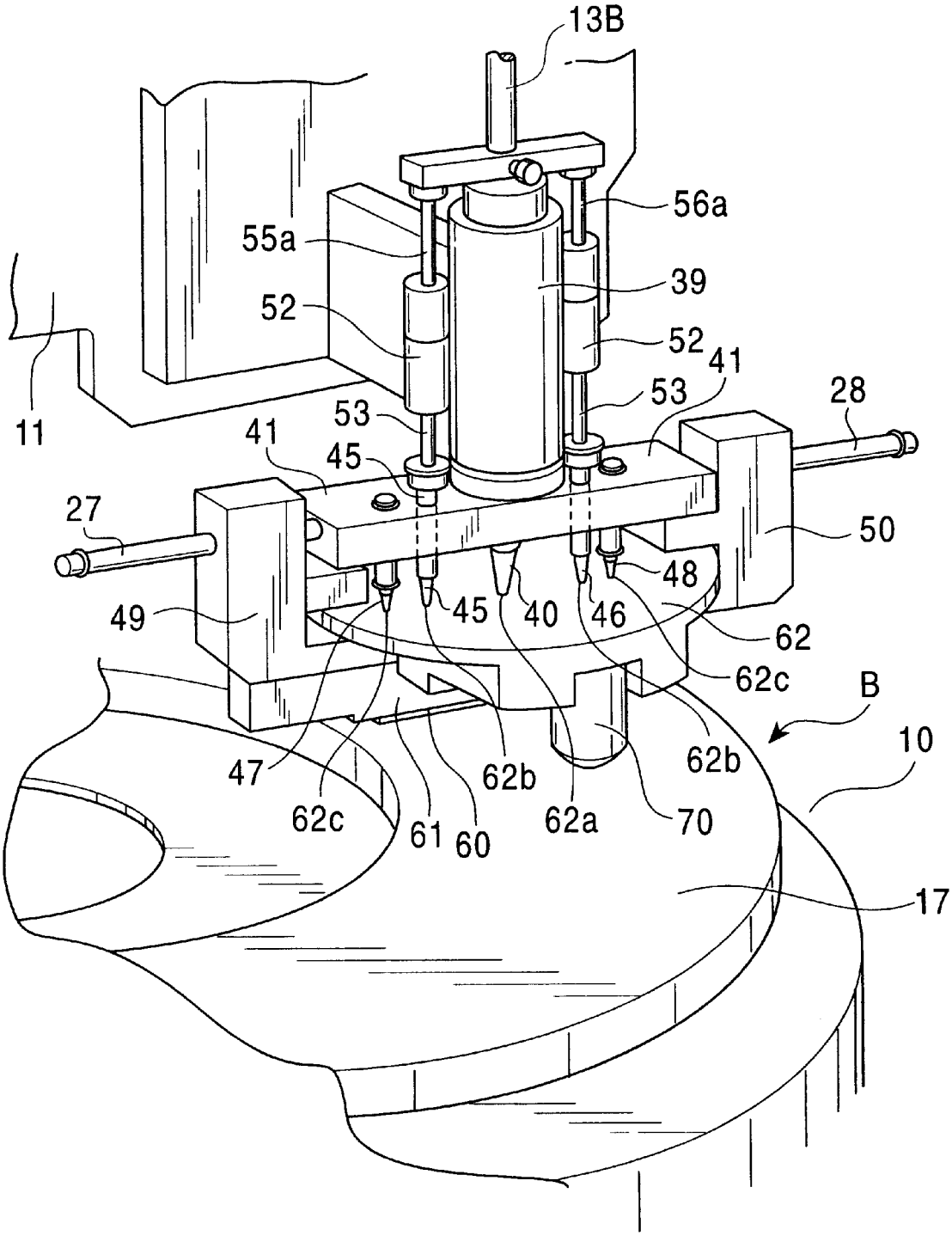
FIG. 7 is a perspective view illustrating a state in which the workpiece is being lapped by the lapping apparatus of FIG. 1.

In the back surface of the substrate 62 of the mounting jig B of FIG. 6 (that is, in the bottom surface in FIG. 6, or in the top surface in FIG. 7) are formed a recess 62*a* in the center portion thereof, and recesses 62*b* and 62*b* and through holes 62*c* and 62*c* on both sides of the recess 62*a*. The recess 62*a* is formed so as to receive an end of the presser rod 40. The recesses 62*b* are formed so as to receive ends of their respective adjuster rods 45 and 46. The through holes 62*c* are formed so as to receive ends of their respective rocking rods 47 and 48.

By virtue of the above-described structure, when an end surface of the workpiece 60 bonded to the correction jig 61 and an end surface of the dummy head 70 are, as shown in FIG. 4, faced downward so that the mounting jig B is turned upside down, end portions of the support pawls 49 and 50 of the above-described holding portion 15 sandwich both sides of the disk-shaped substrate 62 from below (as shown in FIG. 4), so that the substrate 62, being turned upside down, can be supported and suspended from both sides thereof by the support pawls 49 and 50.

As shown in FIG. 4, the mounting jig B is constructed such that when a tapering end portion of the presser rod 40 is inserted into the recess 62*a* in the substrate 62*a*, turned upside down, from above the recess 62*a*, and tapering ends of the adjuster rods 45 and 46 are inserted into their respective recesses 62*b* and 62*b* in the substrate 62 from above their respective recesses 62*b* and 62*b*, the end surface 60*a* of the workpiece 60 and an end surface of the dummy head 70 can be pressed against the lap surface 17 of the lap plate 10. In addition, the mounting jig B is constructed such that the weight of the above-described support blocks 41 are used to exert a certain load on the center portion of the workpiece 60 through the substrate 62 by the presser rod 40. Further, the mounting jig B is constructed such that, as described above, by adjusting the pressing forces of the adjuster rods 45 and 46 as a result of adjusting the vertical position of the piston 55*a* of the cylinder device 55 and the piston 56*a* of the cylinder device 56, the pressing forces on both end portions of the workpiece 60 with respect to the lap plate 10 through the substrate 62, turned upside down, are separately adjusted in order to exert an unbalanced load on the workpiece 60.

In the embodiment, a pressing mechanism H for pressing the workpiece 60 is formed by the adjuster rods 45 and 46, the cylinder devices 55 and 56, and the piston rods 55*a* and 56*a*.

Still further, as shown in FIG. 4, the mounting jig B is constructed so that the rocking rods 47 and 48 of the holding portion 15 pass through their respective through holes 62*c* and 62*c* formed in the substrate 62 turned upside down. Therefore, the support shaft 13 can undergo reciprocating oscillatory rotational motion, while the rocking rods 47 and 48 are inserted in their respective through holes 62*c* and 62*c*. By causing the support shaft 13 to undergo reciprocating oscillatory rotational motion, the slide shaft 13B and the support blocks 41 are made to undergo oscillatory rotational motion at the same time. At the same time, an end surface of the workpiece 60 and an end surface of the dummy head 70 can be made to undergo reciprocating oscillatory rotational motion while they are pressed against the lap surface 17 of the lap plate 10.

Although in this embodiment only one support shaft 13 is disposed with respect to the lap plate 10, it is obvious that two such support shafts 13 can be disposed on the left and right sides of the lap plate 10. In this case, holding portions 15 are provided for the left and the right support shafts 13 in order t o mount workpieces 60 to their respective holding portions 15. The two support shafts 13 are constructed so that the left and right working pieces 60 can be processed at the lap plate 10 at the same time.

Here, it is possible to enhance lapping operations because they can be performed at the same time at the left and right holding portions. In addition, it is possible to continue lapping operations by raising, at the moment lapping operations are completed at this holding portion 15, one of the support shafts 13 while it is supported by the support pawls 49 and 50, so that the workpiece 60 is separated from the lap surface 17. Then, the support pawls 49 and 50 are detached from the mounting jig B in order to remove the mounting jig B from the holding portion 15 and to replace it with another mounting jig B with an unlapped workpiece 60 mounted thereto. After the replacement, the unlapped workpiece 60 is pressed against the lap plate 10 for lapping.

Hereunder, a description will be given of the case where lapping is performed on a workpiece 60 with the lapping apparatus A with the above-described structure.

Figure 10:
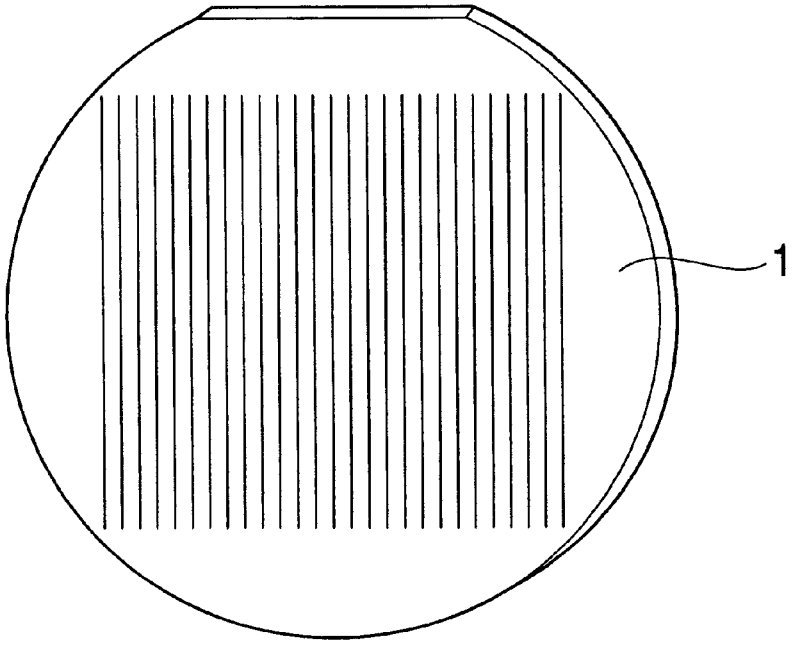
FIG. 10 PRIOR ART
FIG. 10 schematically illustrates the state of arrangement of a plurality of magnetic head devices formed on a commonly used wafer.
Figure 11:
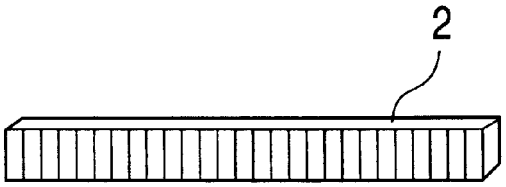
FIG. 11 PRIOR ART
FIG. 11 is a perspective view of a bar sliced from the wafer of FIG. 10.
Figure 12:
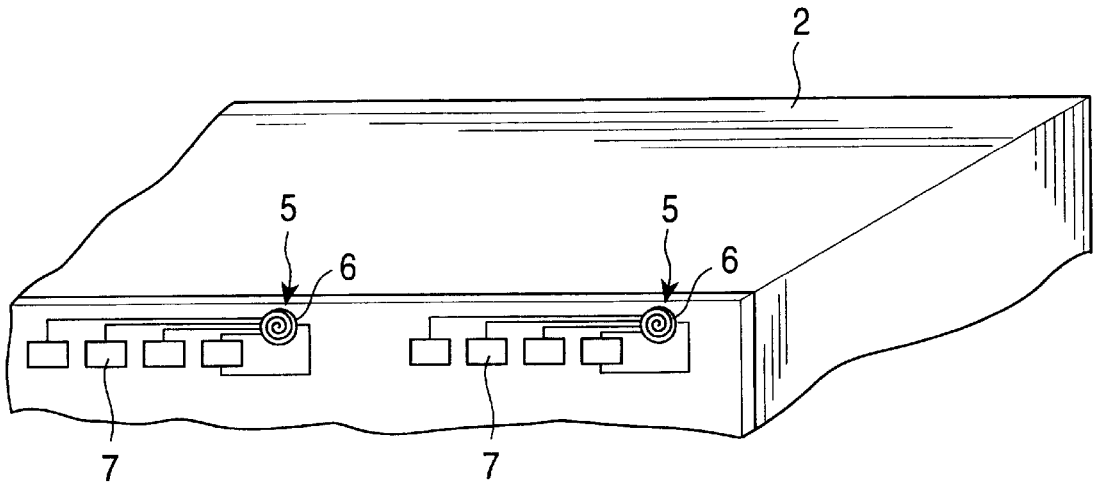
FIG. 12 PRIOR ART
FIG. 12 is an enlarged view of thin-film magnetic head devices at the corners of the bar of FIG. 11.
Figure 13:
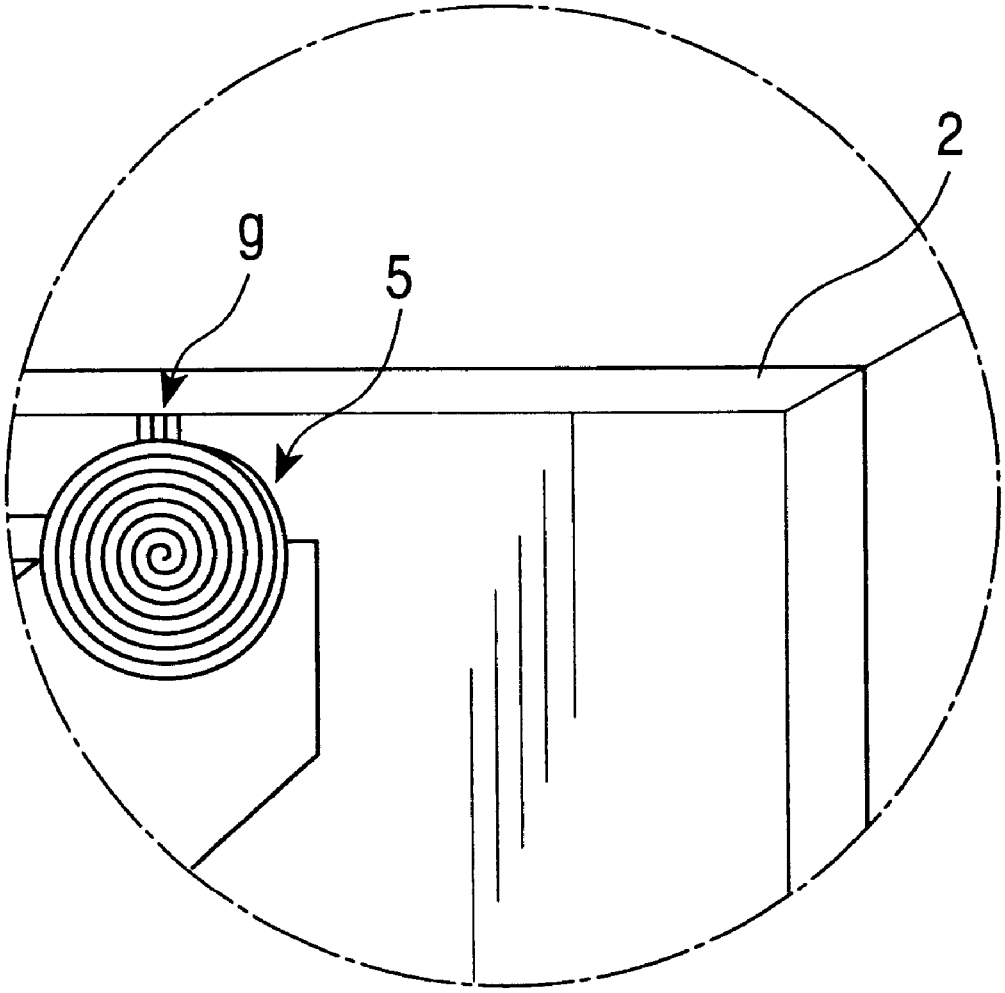
FIG. 13 PRIOR ART
FIG. 13 is an enlarged view of one of the thin-film magnetic head devices of FIG. 12.

The workpiece 60 to be lapped with the lapping apparatus A of the embodiment is a long and narrow bar-shaped workpiece sliced from the wafer 1 shown in FIG. 10. Like the sliced bar 2 shown in FIGS. 12 and 13, the workpiece 60 has a plurality of magnetic head devices 5 hoizontally and vertically arranged thereon. When the longer side of the workpiece 60 is horizontally disposed, magnetic gaps g of the thin-film magnetic head devices 5 are positioned at the upper surface side of the workpiece 60. These magnetic gaps g are gradually lapped by the lapping apparatus A of the embodiment in order to lap them to depths within a specified range.

As shown in FIG. 6, the workpiece 60 is bonded to the top surface of the correction jig 61.

The correction jig 61 is interposed between the receiving seat 63 and the presser plate 68 of the mounting jig B, and the adjuster bolt 69 is tightened. In this state, the position of an end surface of the workpiece 60 and the position of an end portion of the dummy head 70 are adjusted so that they are at the same height.

Then, the holding portion 15 is raised as a result of raising the slide shaft 13B. The jig B, being turned upside down, is placed on the lap surface 17 of the lap plate 10. From the raised positions, the slide shaft 13B and the holding portion 15 are moved downward to insert ends of the rocking rod 47 and the rocking rod 48 into their respective through holes 62*c* and 62*c* in the substrate 62 of the mounting jig B; to insert ends of the adjuster rod 45 and the adjuster rod 46 into their respective recesses 62*b* and 62*b* in the substrate 62; and to insert an end of the presser rod 40 into the recess 62*a* formed in the center portion of the substrate 62. Thereafter, a motor 20 and motors 33 and 33 are started. The lap plate 10 is previously rotationally driven.

When the above-described operations are carried out, the base 11 reciprocates horizontally towards the left and right, and the holding portion 15 that supports the workpiece 60 moves horizontally towards the left and right. At the same time, the support shaft 13 undergoes reciprocating oscillatory motion around its axis as center, at a predetermined angle, so that the end surface of the workpiece 60 is lapped.

As can be understood from the foregoing description, in the lapping apparatus A of the embodiment, an end surface of the workpiece is lapped by making it undergo oscillatory rocking motion while it is made to reciprocate horizontally towards the left and right with respect to the lap surface 17 of the lap plate 10. This makes it possible to very uniformly rub the end surface of the workpiece 60 against the lap surface 17 of the lap plate 10. As a result, the end surface of the workpiece 60 can be lapped with very high precision. Since the workpiece 60 can be uniformly pressed against the lap surface 17, wearing of one side of the lap plate 10 does not occur.

In addition, in the lapping apparatus A of the embodiment, the horizontally long, bar-shaped workpiece 60 can be lapped while it is supported by the correction jig 61, making it possible to perform lapping operations with very high precision.

Further, in the lapping apparatus A of the embodiment, lapping operations can be performed while pressing the workpiece 60 against the lap plate 10, since the dummy head 70 of the mounting jig B and the workpiece 60 are disposed so that the ends of the workpiece 60 and the tip of the dummy head 70 occupy vertices of a triangle formed by joining the tip of the dummy head 70 and the ends of the workpiece 60 with a line. Therefore, lapping operations can be carried out with higher precision. In other words, without the dummy head 70, it is very difficult during lapping operations to achieve continuous, precise, and uniform contact between the lap surface 17 of the lap plate 10 and the surface of the long, narrow, bar-shaped workpiece 60 to be lapped. However, with the dummy head 70, the mounting jig B and the workpiece 60 can be disposed such that these component parts are supported at three points. In this state in which they are supported at three points, when they are pressed against the lap surface 17 of the lap plate 10, lapping operations can be continued while the workpiece 60 and the dummy head 70 are pressed uniformly against the lap surface 17. This contributes to precise lapping operations.

The lapping apparatus A of the embodiment is used to lap gap portions in the workpiece 60 having formed thereon a plurality of thin-film magnetic head devices 5. These gap portions need to be lapped with a very high precision that is most difficult to achieve. For example, a slight bending of the workpiece 60 may result in non-uniform lapping. Here, slight bending in the center portion and a side portion of the workpiece 60 may result in non-uniform lapping. This problem can be solved by carrying out lapping operations by making the cylinder device 55 or the cylinder device 56 through its corresponding adjuster rod 45 or its corresponding adjuster rod 46 to exert a large load onto the end portion side of the workpiece 60 that is not sufficiently lapped. In other words, the problem can be solved by carrying out lapping operations while applying an unbalanced load on the workpiece 60.

In the lapping apparatus A of the embodiment, the following method can be used to lap the workpiece 60 while adjusting the pressing forces applied by the adjuster rods 45 and 46 when the lapping state of the workpiece 60 during lapping operations is being monitored.

Since a plurality of thin-film magnetic head devices 5 are formed on the workpiece 60, a probe needle of a circuit inspecting device is brought into contact with the electrode pads of the thin-film magnetic head devices 5 at both end portions of the workpiece 60. Then, during lapping operations, an inspection signal is transmitted to the predetermined thin-film magnetic head devices 5 on both end portions of the workpiece 60.

As the lapping operations progress, the gap lapping operations also progress, so that the output signal obtained from the thin-film magnetic head devices 5 change. If such output signals are detected, the lapping state of the two end portions of the workpiece 60 can be successively monitored. Therefore, in the case where further slight bending occurs even when the workpiece 60 is secured to the correction jig 61, uniform lapping operations can be carried out by adjusting the loads applied to both end portions of the workpiece 60 by the adjuster rods 45 and 46, in accordance with the results of the monitored detection signals obtained at the same time. For the detection signals, a standard signal is previously obtained as a result of a lapping operation on a sample, and recorded. Based on this recorded signal, signal comparison is carried out.

Based on FIGS. 8 and 9, a description will now be given of a controlling operation carried out when thin-film head devices, formed on the workpiece 60 to be lapped, use MR elements (magnetoresistive effect elements).

A thin-film magnetic head using an MR element is constructed so that a magnetic signal recorded on a magnetic recording medium can be read when changes occur in the resistance of the MR element disposed in the interior of the thin-film magnetic head. Accordingly, if, during processing of a gap of such a thin-film magnetic head, a direct current voltage is applied to an electrode pad of the thin-film magnetic head and the resistance thereof is measured, it can be easily determined whether or not the gap processing has been completed.

Figure 8:
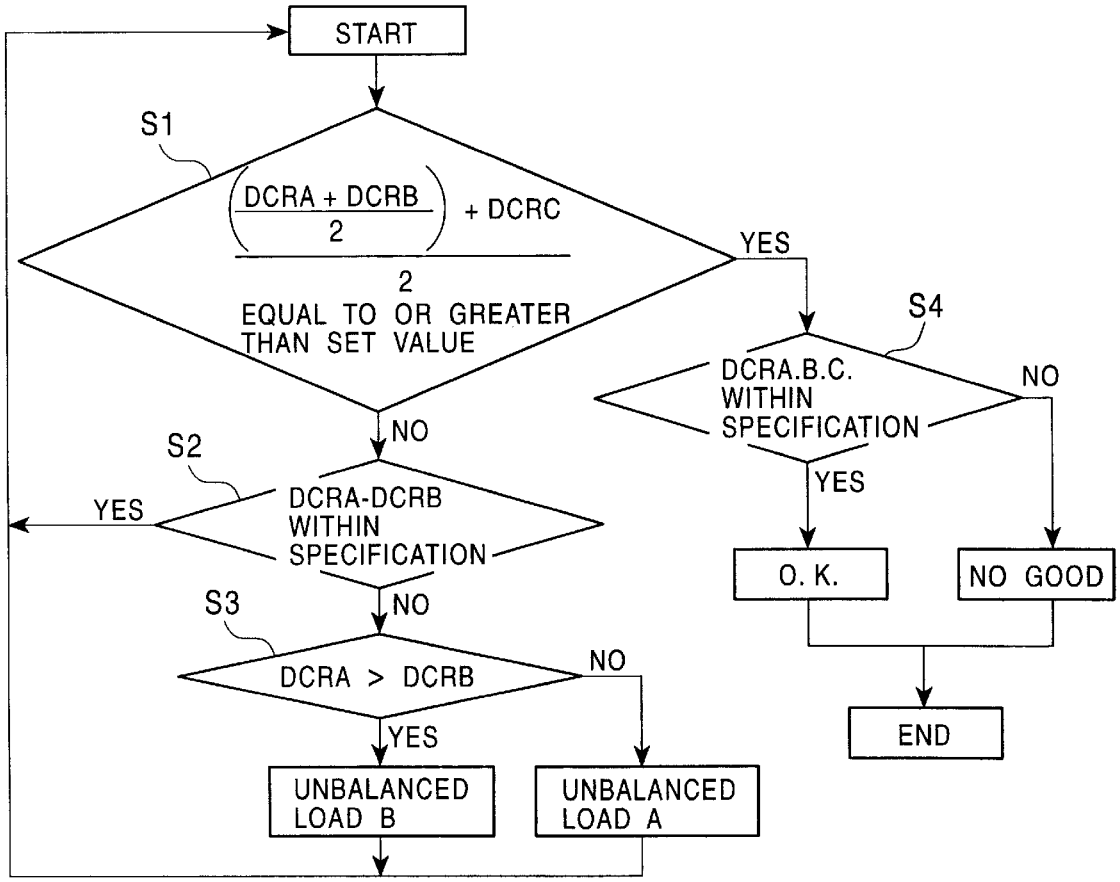
FIG. 8 is a flowchart used to illustrate the lapping amount control state when the workpiece is being lapped by the lapping apparatus of FIG. 1.

FIG. 8 is a signal determination flowchart for the above-described case.

Figure 9:
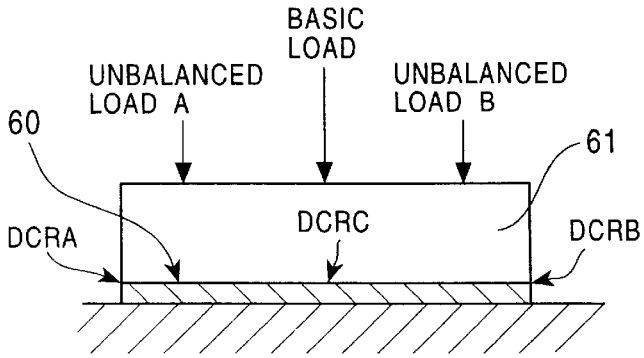
FIG. 9 illustrates a state in which the workpiece is subjected to loads.

If, as shown in FIG. 9, an unbalanced load A can be applied to the bar-shaped workpiece 60 by the adjuster rod 45 of the lapping apparatus A shown in FIGS. 1 to 7; and an unbalanced load B can be applied to the bar-shaped workpiece 60 shown in FIG. 9 by the adjuster rod 46; and a basic load can be applied to the bar-shaped workpiece 60 of FIG. 9 by the presser rod 40, then starting lapping operations allows detection of the resistance, which can be indicated by DCRA, of the thin-film magnetic head device at the left end portion of the workpiece 60 shown in FIG. 9; and detection of the resistance, which can be indicated by DCRB, of the thin-film magnetic head device at the right end portion of the workpiece 60 shown in FIG. 9; and detection of the resistance, which can be indicated by DCRC, of the thin-film magnetic head device at the center portion of the workpiece 60 shown in FIG. 9, respectively.

As illustrated in FIG. 8, after starting detection of each of the resistances, Step S1 is carried out to determine whether or not a value obtained by using the formula [{(DCRA+DCRB)/2}+DCRC]/2 is equal to or greater than a prescribed value. If it is not, the process proceeds to Step S2.

In Step S2, a determination is made as to whether or not a value obtained by subtracting DCRB from DCRA (DCRA−DCRB) is within specification values. If it is, the process goes back to Step S1, and lapping operations are continued.

If a determination is made that the value obtained by subtracting DCRB from DCRA is not within specification values, the process proceeds to Step S3 in order to determine whether or not DCRA is greater than DCRB (DCRA<DCRB).

If it is, then lapping operations are continued while applying unbalanced load B, whereas if it is not, lapping operations are continued while applying unbalanced load A. After application of the unbalanced load B or the unbalanced load A, the process goes back to Step S1. As described above, in order to apply an unbalanced load A, the cylinder device 55 is used to increase the amount of force pressing the workpiece 60 against the lap plate 10 through the adjuster rod 45, the mounting jig B, and the correction jig 61. Also as described above, in order to apply an unbalanced load B, the cylinder device 56 is used to increase the force pressing the workpiece 60 against the lap plate 10 through the adjuster rod 46, the mounting jig B, and the correction jig 61.

If in Step S1 the value obtained by the formula [{(DCRA+DCRB)/2}+DCRC]/2 is equal to or greater than the prescribed value, the process proceeds to Step S4. Here, if the DCRA value, the DCRB value, and the DCRC value are within specification values, a determination is made that processing operations are completed. If these values are not within specification values, a determination is made that lapping operations are not properly carried out.

In accordance with the flowchart, lapping operations are carried out based on the measured resistance values of the thin-film magnetic head devices at the center, left end portion, and right end portion of the workpiece 60. By carrying out lapping operations while applying an unbalanced load A or an unbalanced load B based on the measured resistance values, even very slight lapping failures that are caused by very slight bending of the workpiece 60 that cannot be corrected by the correction jig can be easily eliminated. Therefore, even very precise lapping operations, which must be achieved when, for example, a gap portion of a thin-film magnetic head is being processed, can be achieved without hindrance by using the above-described lapping apparatus A to carry out lapping operations following the steps of the flowchart of FIG. 8.

As can be understood from the foregoing description, according to the present invention, in the case where lapping operations are carried out by pressing a workpiece supported by a holding portion against a lap plate, when the holding portion is constructed so that it can freely oscillate and move in a diametrical direction of the lap plate or in a direction parallel to the diametrical direction thereof, the workpiece can be uniformly pressed against the lap surface of the lap plate. Therefore, it is possible to carry out lapping operations more precisely, and to prevent wearing of one side of the lap plate.

When the holding portion is constructed so that it can oscillate, lapping operations can be carried out by pressing the workpiece against the lap plate while making the workpiece oscillate as a result of making a supporting shaft that supports the holding portion oscillate freely around its axis alternately towards the left and right within an angle range equal to or less than 90 degrees.

When the holding portion, having a workpiece mounted thereto, comprises a correction jig with a workpiece mounted thereto; a mounting jig for gripping the correction jig; and a pressing mechanism for freely pressing the center portion and both end portions of the correction jig towards the lap plate using separate pressing forces, lapping operations can be carried out while applying an unbalanced load to the workpiece. Therefore, even when deformation, such as bending, occurs in the workpiece, lapping operations with high precision can be carried out. In particular, when the workpiece is a substrate having formed thereon thin-film magnetic heads including a GMR element, a write head gap portion and a read head gap portion, both of which determine the performance of the GMR element, can be processed by lapping. Accordingly, since it is possible to carry out lapping operations with high precision, it is possible to precisely process the gap portions of both the read head and the write head to the required depths and to precisely process an end portion of a write magnetic pole to the required throat height.

In detail, the pressing mechanism can be constructed so that a plurality of rods, which can separately press their respective center portion and both end portions of a workpiece, are disposed so that they can freely move closer to and away from the lap plate. Even when the pressing mechanism is constructed in this way, lapping operations can be carried out while applying an unbalanced load to the workpiece. By virtue of this structure, even when deformation, such as bending, occurs in the workpiece, lapping operations can be carried out with high precision.

When a dummy head, for balancing and adjusting lapping operations, is provided at the mounting jig so that a tip thereof and both end portions of the workpiece occupy vertices of a triangle formed by joining the tip of the mounting jig and both end portions of the workpiece with a line, three points can be pressed during lapping operations carried out while pressing the workpiece and the dummy head against the lap plate through the mounting jig. Since the pressing forces can be exerted uniformly and stably, the workpiece can be uniformly pressed against the lap plate, thereby increasing the precision with which lapping is carried out on the workpiece.

What is claimed is:

1. A sizing lapping apparatus comprising:

a rotatably provided disk-shaped lap plate;

a lapping liquid supplying device for supplying a lapping liquid from a supplying tube to the lap plate;

at least one holding portion for holding a workpiece, the at least one holding portion being used to press the workpiece against the lap plate;

a support shaft, provided in an erected state with respect to the lap plate, for supporting the at least one holding portion;

an oscillating mechanism for causing the support shaft to undergo oscillatory rotational motion around an axis thereof;

a base for supporting the support shaft so that the support shaft freely rotates around the axis thereof; and a base rocking mechanism for reciprocating the base in a diametrical direction of the lap plate or in a direction substantially parallel to the diametrical direction of the lap plate;

wherein the support shaft that supports the at least one holding portion oscillates freely around the axis thereof at an angle within a range equal to or less than 90 degrees and alternately towards the left and right.

2. A sizing lapping apparatus according to claim 1, wherein the holding portion that supports the workpiece comprises a correction jig having the workpiece mounted thereto; a mounting jig for gripping the correction jig; and a pressing mechanism for freely pressing towards the lap plate a center portion side and both end portion sides of the correction jig by separate pressing forces.

3. A sizing lapping apparatus according to claim 2, wherein the holding portion has provided thereat a plurality of rods which separately and freely move closer to and away from the lap plate, with the rods freely and separately pressing against the lap plate both end portion sides and a center portion side of the workpiece supported by the holding portion.

4. A sizing lapping apparatus according to claim 3, wherein the holding portion has further provided thereat a mounting jig having the workpiece secured thereto, with a dummy head for balancing and adjusting lapping operations being mounted at the mounting jig, and with a point to which pressure is applied towards the lap plate by the support shaft corresponding to an intermediate point between the workpiece and the dummy head.

5. A sizing lapping apparatus according to claim 2, wherein the holding portion has provided thereat a mounting jig having the workpiece secured thereto, with a dummy head for balancing and adjusting lapping operations being mounted at the mounting jig, and with a point to which pressure is applied towards the lap plate by the support shaft corresponding to an intermediate point between the workpiece and the dummy head.

6. A sizing lapping apparatus according to claim 1, wherein the holding portion has provided thereat a plurality of rods which separately and freely move closer to and away from the lap plate, with the rods freely and separately pressing against the lap plate both end portion sides and a center portion side of the workpiece supported by the holding portion.

7. A sizing lapping apparatus according to claim 6, wherein the holding portion has further provided thereat a mounting jig having the workpiece secured thereto, with a dummy head for balancing and adjusting lapping operations being mounted at the mounting jig, and with a point to which pressure is applied towards the lap plate by the support shaft corresponding to an intermediate point between the workpiece and the dummy head.

8. A sizing lapping apparatus according to claim 1, wherein the holding portion has provided thereat a mounting jig having the workpiece secured thereto, with a dummy head for balancing and adjusting lapping operations being mounted at the mounting jig, and with a point to which pressure is applied towards the lap plate by the support shaft corresponding to an intermediate point between the workpiece and the dummy head.

9. A sizing lapping apparatus comprising:

a rotatably provided disk-shaped lap plate;

a lapping liquid supplying device for supplying a lapping liquid from a supplying tube to the lap plate;

at least one holding portion for holding a workpiece, the at least one holding portion being used to press the workpiece against the lap plate;

a support shaft, provided in an erected state with respect to the lap plate, for supporting the at least one holding portion;

an oscillating mechanism for causing the support shaft to undergo oscillatory rotational motion around an axis thereof;

a base for supporting the support shaft so that the support shaft freely rotates around the axis thereof; and a base rocking mechanism for reciprocating the base in a diametrical direction of the lap plate or in a direction substantially parallel to the diametrical direction of the lap plate;

wherein the holding portion that supports the workpiece comprises a correction jig having the workpiece mounted thereto; a mounting jig for gripping the correction jig; and a pressing mechanism for freely pressing towards the lap plate a center portion side and both end portion sides of the correction jig by separate pressing forces.

10. A sizing lapping apparatus according to claim 9, wherein the holding portion has provided thereat a plurality of rods which separately and freely move closer to and away from the lap plate, with the rods freely and separately pressing against the lap plate both end portion sides and a center portion side of the workpiece supported by the holding portion.

11. A sizing lapping apparatus according to claim 10, wherein the holding portion has further provided thereat a mounting jig having the workpiece secured thereto, with a dummy head for balancing and adjusting lapping operations being mounted at the mounting jig, and with a point to which pressure is applied towards the lap plate by the support shaft corresponding to an intermediate point between the workpiece and the dummy head.

12. A sizing lapping apparatus according to claim 9, wherein the holding portion has provided thereat a mounting jig having the workpiece secured thereto, with a dummy head for balancing and adjusting lapping operations being mounted at the mounting jig, and with a point to which pressure is applied towards the lap plate by the support shaft corresponding to an intermediate point between the workpiece and the dummy head.

13. A sizing lapping apparatus comprising:

a rotatably provided disk-shaped lap plate;

a lapping liquid supplying device for supplying a lapping liquid from a supplying tube to the lap plate;

at least one holding portion for holding a workpiece, the at least one holding portion being used to press the workpiece against the lap plate;

a support shaft, provided in an erected state with respect to the lap plate, for supporting the at least one holding portion;

an oscillating mechanism for causing the support shaft to undergo oscillatory rotational motion around an axis thereof;

a base for supporting the support shaft so that the support shaft freely rotates around the axis thereof; and a base rocking mechanism for reciprocating the base in a diametrical direction of the lap plate or in a direction substantially parallel to the diametrical direction of the lap plate;

wherein the holding portion has provided thereat a plurality of rods which separately and freely move closer to and away from the lap plate, with the rods freely and separately pressing against the lap plate both end portion sides and a center portion side of the workpiece supported by the holding portion.

14. A sizing lapping apparatus according to claim 13, wherein the holding portion has further provided thereat a mounting jig having the workpiece secured thereto, with a dummy head for balancing and adjusting lapping operations being mounted at the mounting jig, and with a point to which pressure is applied towards the lap plate by the support shaft corresponding to an intermediate point between the workpiece and the dummy head.

15. A sizing lapping apparatus comprising:

a rotatable provided disk-shaped lap plate;

a lapping liquid supplying device for supplying a lapping liquid from a supplying tube to the lap plate;

at least one holding portion for holding a workpiece, the at least one holding portion being used to press the workpiece against the lap plate;

a support shaft, provided in an erected state with respect to the lap plate, for supporting the at least one holding portion;

an oscillating mechanism for causing the support shaft to undergo oscillatory rotational motion around an axis thereof;

a base for supporting the support shaft so that the support shaft freely rotates around the axis thereof; and a base rocking mechanism for reciprocating the base in a diametrical direction of the lap plate or in a direction substantially parallel to the diametrical direction of the lap plate;

wherein the holding portion has provided thereat a mounting jig having the workpiece secured thereto, with a dummy head for balancing and adjusting lapping operations being mounted at the mounting jig, and with a point to which pressure is applied towards the lap plate by the support shaft corresponding to an intermediate point between the workpiece and the dummy head.

* * * * *

UNITED STATES PATENT AND TRADEMARK OFFICE

CERTIFICATE OF CORRECTION

PATENT NO. : 6,238,276 B1
DATED : May 29, 2001
INVENTOR(S) : Masaharu Miyazaki et al.

It is certified that error appears in the above-identified patent and that said Letters Patent is hereby corrected as shown below:

Column 14,
Line 36, delete "rotatable" and substitute -- rotatably -- in its place.

Signed and Sealed this

Twenty-eighth Day of May, 2002

*Attest:*

*Attesting Officer*

JAMES E. ROGAN
*Director of the United States Patent and Trademark Office*